United States Patent [19]

Stier et al.

[11] 4,412,471

[45] Nov. 1, 1983

[54] SYNCHRONIZATION SYSTEM FOR AN ELECTRONIC MUSICAL INSTRUMENT HAVING PLURAL AUTOMATIC PLAY FEATURES

[75] Inventors: Glenn R. Stier, Vernon Hills; Moshe Mizrachi, Des Plaines, both of Ill.

[73] Assignee: Norlin Industries, Inc., White Plains, N.Y.

[21] Appl. No.: 391,018

[22] Filed: Jun. 22, 1982

[51] Int. Cl.[3] ..... G10F 1/00

[52] U.S. Cl. ..... 84/1.03; 84/1.24; 84/DIG. 12

[58] Field of Search ..... 84/1.01, 1.03, DIG. 12, 84/1.24

[56] References Cited

U.S. PATENT DOCUMENTS

| | | | |
|---|---|---|---|
| 4,217,805 | 8/1980 | Tamada | 84/1.03 |
| 4,242,936 | 1/1981 | Swain | 84/1.03 |
| 4,244,258 | 1/1981 | Finch | 84/1.03 |
| 4,314,493 | 2/1982 | Kondo | 84/1.03 |
| 4,315,451 | 2/1982 | Uchiyama et al. | 84/1.03 |
| 4,344,344 | 8/1982 | Nakada et al. | 84/1.03 |
| 4,357,854 | 11/1982 | Hirano | 84/1.03 |
| 4,387,620 | 6/1983 | Okamoto et al. | 84/1.03 |

*Primary Examiner*—F. W. Isen

*Attorney, Agent, or Firm*—Ronald J. Kransdorf

[57] ABSTRACT

An electronic musical instrument includes first and second ROM's addressable for producing respective two-bar musical patterns representing independent automatic rhythm and music style features. Both ROM's are operable in response to a common clock signal to facilitate synchronous operation thereof regardless of the order in which the two features are played. In particular, the states of a rhythm counter clocked by the clock signal are decoded for generating a first control code tracking the extent of completion of the two-bar automatic rhythm pattern, the first control code being used to initialize start-up of the music style pattern during a performance of the automatic rhythm feature to insure completion of the two musical patterns in time coincidence. Upon start-up of the automatic rhythm feature during a performance of the music style pattern, a second control code is calculated to initiate the automatic rhythm pattern to insure time coincidental completion of the two musical patterns.

11 Claims, 5 Drawing Figures

SYNCHRONIZATION SYSTEM FOR AN ELECTRONIC MUSICAL INSTRUMENT HAVING PLURAL AUTOMATIC PLAY FEATURES

BACKGROUND

The present invention relates generally to the field of electronic musical instruments, such as electronic organs. More specifically, the invention concerns apparatus for synchronizing the operation of two independent automatic-play features of an electronic organ such as automatic rhythm and automatic orchestration.

Automatic-play features have become extremely popular in present-day electronic organs largely as a result of the availability and widespread use of microprocessors and associated memory chips in those instruments. Through the use of a suitably programmed microprocessor and one or more associated memory chips or ROM's (read only memories), any number of sophisticated automatic-play features may be conveniently implemented in a relatively low cost organ, a feat which would have been economically prohibitive if not practically impossible in even the most expensive pre-microprocessor electronic organs. The provision of such plural automatic-play features however, introduces certain new problems which must be considered by the organ designer and resolved in a manner so as to preserve the musical integrity of the instrument. The invention described herein concerns one such problem; namely, establishing the musical integrity of a microprocessor-based electronic organ by insuring the synchronous operation of independent automatic rhythm and orchestration features regardless of the order in which those features are selected for playing.

An automatic rhythm feature may be implemented in a microprocessor-based electronic organ as generally disclosed in U.S. Pat. No. 4,242,936. The automatic rhythm feature disclosed in this patent employs a rhythm ROM which is programmed for storing at each of a plurality of consecutive memory locations a rhythm beat instruction together with an associated timing or skip instruction defining the number of clock intervals before the next beat instruction is to be addressed. The rhythm pattern stored in the ROM may be, for example, two bars in length or, stated otherwise, the number of memory locations multiplied by the cumulative total of the stored skip instructions.

Automatic orchestration or music style features, see for example copending application Ser. No. 307,161, filed Sept. 30, 1981, entitled Orchestral Accompaniment Techniques (continuation of application Ser. No. 3,584 filed Jan. 15, 1979) are in some respects typically implemented in an analagous manner in that a ROM, in this case a music style ROM, is programmed for storing at each of a plurality of consecutive memory locations a particular music style instruction. As the consecutive memory locations are sequentially addressed, the music style instrumentation circuits of the organ are operated for producing an output tone signal having a desired musical style. The musical style pattern stored in the ROM may also be, for example, two bars in length.

Each of these automatic features, i.e. automatic rhythm and automatic orchestration or musical style, are independent of each other and may be individually played without concern of the other. However, it has been found that when both are attempted to be played simultaneously, the most musically pleasing effect results when the two features operate in a synchronous or musically compatible manner. More specifically, it has been found that where both the stored rhythm pattern and the stored musical style pattern are equal in length, two bar patterns for example, and both are being played at the same time, the most musically pleasing effect occurs when both ROM's are being addressed in synchronism. That is, the most musically pleasing effect occurs when the two-bar rhythm and music style patterns are derived from the memories in time coincidence such that the first memory locations of the two ROM's are addressed at the same time. Similarly, both final memory locations should also be addressed at the same time. While such synchronous operation of the two ROM's may be conviently realized by initiating the playing of both the automatic rhythm and music style features at precisely the same point in time, it is frequently desired to initiate one of the features after the other has been in operation for some time. In this case, the two features will be played asynchronously thereby creating an undesired musical effect unless steps are taken to re-synchronize the addressing of the two ROM's.

It is therefore a basic object of the present invention to provide an electronic musical instrument having plural automatic-play features which may be simultaneously operated to produce a desired musical effect.

It is a more specific object of the invention to provide an electronic musical instrument having at least two memories each storing an independent automatic-play feature pattern of predetermined equal lengths and a system for maintaining synchronism between the two features regardless of the order in which they are operated.

These and other objects are achieved according to the invention by operating both an automatic rhythm and an automatic music style feature in response to a common clock signal. Both features, when initiated, produce two-bar musical patterns. The states of a rhythm counter clocked by the clock signal are decoded for generating a first control code tracking the extent of completion of the two-bar automatic rhythm pattern, the first control code being used to initialize start-up of the music style pattern during a performance of the automatic rhythm feature to insure completion of the two musical patterns in time coincidence. A second control code is calculated in response to the clock signal to initialize start-up of the automatic rhythm pattern during a performance of the music style feature to insure completion of the two musical patterns in time coincidence.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawing in which:

DETAILED DESCRIPTION OF THE PREFERRED EMBODIMENT

Figure 1:
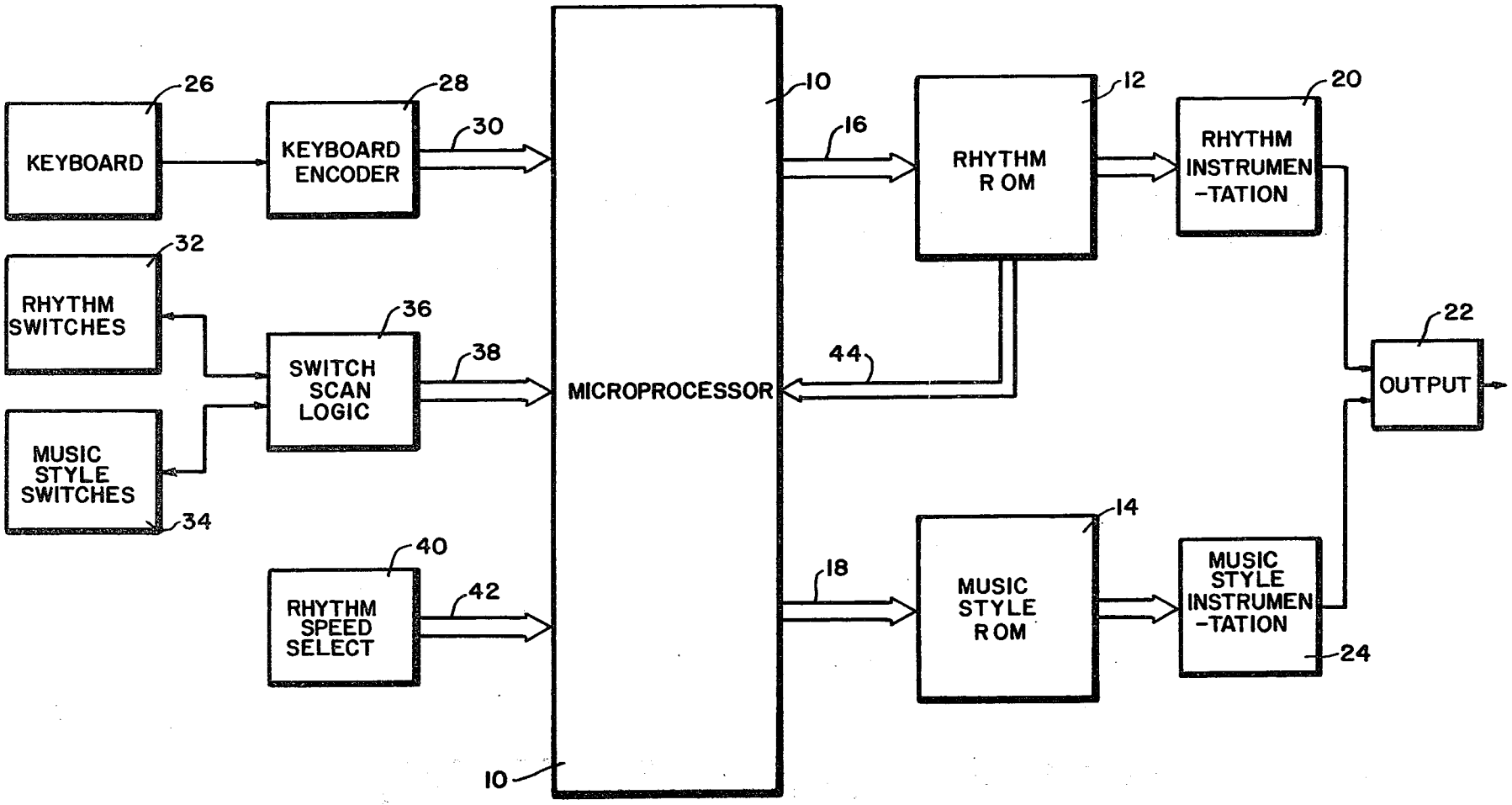
FIG. 1 is a block diagram illustrating a microprocessor-based electronic organ incorporating the invention.

Referring now to the drawings, FIG. 1 depicts a microprocessor-based electronic organ having an automatic rhythm feature and an automatic orchestration or music style feature. The automatic rhythm feature is implemented by a rhythm ROM 12 while the automatic orchestration or music style feature is implemented by a music style ROM 14. Both the rhythm ROM 12 and the music style ROM 14 are operated in response to address signals supplied by the microprocessor 10 over address busses 16 and 18 respectively. As will be explained in further detail hereinafter, rhythm ROM 12 is programmed for storing a plurality of rhythm beat instructions which operate a plurality of conventional rhythm instrumentation circuits 20 for generating an audible rhythm pattern through a suitable output system 22. In a similar manner, music style ROM 14 is programmed for storing a plurality of music syle instruction which operate a plurality of conventional music style instrumentation circuits 24 for generating a tone signal having a desired musical style through output system 22.

The electronic organ shown in FIG. 1 also includes a keyboard 26 which includes a plurality of playing keys arranged into one or more manuals. A conventional keyboard encoder 28 interfaces with keyboard 26 and is operative for sequentially scanning the various playing keys and for communicating the status thereof to microprocessor 10 over a bus 30. In particular, keyboard encoder 28 is operative for coupling a multibit code uniquely identifying each played key of keyboard 26 for storage in a suitable memory of microprocessor 10. The organ further includes a plurality of rhythm select switches or tabs 32 and a plurality of music style switches or tabs 34. Rhythm switches 32 enable the player to select a desired rhythm pattern, e.g. rumba, march, rock, etc., for automatic performance while music style switches 34 enable the selection and automatic performance of a desired music style such as jazz guitar, Blue Grass, Big Band, Baroque etc. Both rhythm select switches 32 and music style switches 34 are repetitively scanned by a conventional switch scan logic circuit 36 which, in a manner analagous to keyboard encoder 28, communicates the status of rhythm select switches 32 and music style switches 34 for storage in a suitable memory of microprocessor 10 over a bus 38. Finally, a conventional rhythm speed select circuit 40 couples a multibit code representing a player selected speed at which it is desired to operate either or both the automatic rhythm feature and the automatic music style feature. This automatic-play speed multibit code is coupled to microprocessor 10 via a third input bus 42. Typically, rhythm speed select circuit 40 comprises a player-operable potentiometer for generating an analog voltage representing a selected playing speed and an analog to digital converter for converting the generated analog voltage to a corresponding multibit code for application to the microprocessor.

Referring back to rhythm ROM 12, two bars, i.e. eight beats, of a desired rhythm pattern may be stored in a plurality of consecutive memory locations by storing at each memory location a rhythm beat instruction together with a timing instruction defining the amount of time to elapse before the next memory location is to be addressed. With reference to FIG. 1, the timing instructions, hereinafter referred to as time-to-next-beat (TNB) instructions, are fed back from rhythm ROM 12 to microprocessor 10 by a bus 44. Thus, the rhythm beat instructions stored in rhythm ROM 12 are consecutively addressed by microprocessor 10 but at different time intervals in accordance with the values of the TNB instructions. In a preferred embodiment of the invention, each two bar or eight beat rhythm pattern is divided into ninety-six equally spaced time points so that the number of memory location defining a rhythm pattern multiplied by the cumulative total of TNB instruction values equals ninety-six.

The music style patterns programmed in ROM 14 are also two musical bars in length corresponding to the previously mentioned ninety-six time points. For example, a complete musical style pattern may be organized into four subpatterns each representing two beats of musical notation and stored in four consecutive tables to form the complete two-bar pattern. In addition, certain music style patterns, so-called "four-bar" patterns, may require rhythm ROM 12 to effectively operate at twice the rate of music style ROM 14 as will be further explained hereinafter.

The automatic rhythm and automatic music style features implemented by ROM's 12 and 14 are completely independent of each other and may be individually operated without reference to the other. However, it has been found that when both features are played together, the most musically pleasing effect is realized when the two ROM's 12 and 14 are operated in a time coincident or synchronous manner. That is, it is preferred that the instrument be operated such that the eight-beat rhythm patterns start and end precisely at the same points in time that the eight-beat music style patterns start and end. Thus, while intra-pattern time correspondence of the addressed ROM memory locations will not necessarily be maintained, the complete patterns should be accessed in synchronism whereby a complete two-bar rhythm pattern is played in exactly the same time frame in which a complete two-bar music style pattern is played. Such synchronous operation of the automatic rhythm and music style features may, of course, be realized by initiating the operation of rhythm ROM 12 and music style ROM 14 at their initial memory locations at precisely the same point in time. However, this is extremely difficult to do especially where it is desired to initiate operation of one of the features while the other is already running.

According to the present invention, the foregoing problem is overcome by operating microprocessor 10 in a manner so as to insure synchronous addressing of ROM's 12 and 14 regardless of the order of operation of the automatic rhythm and music style features. In particular, microprocessor 10 includes a rhythm counter 50 (see FIG. 2) which is continuously operated in response to rhythm speed select 40 for repetetively establishing a sequence of ninety-six time point timing intervals, each such timing intervals defining a two-bar musical pattern. Upon initiating operation of either the automatic rhythm or music style feature, the rhythm counter is reset if the other feature is not operating to insure proper initialization of the operated ROM 12 or 14. If, on the other hand, the other feature is running then the state of the rhythm counter is used to determine where to access the newly operated ROM 12 or 14 in order to insure that the musical patterns defined by both ROM's are completed coincidentally insuring subsequent synchronous operation thereof.

Figure 2:
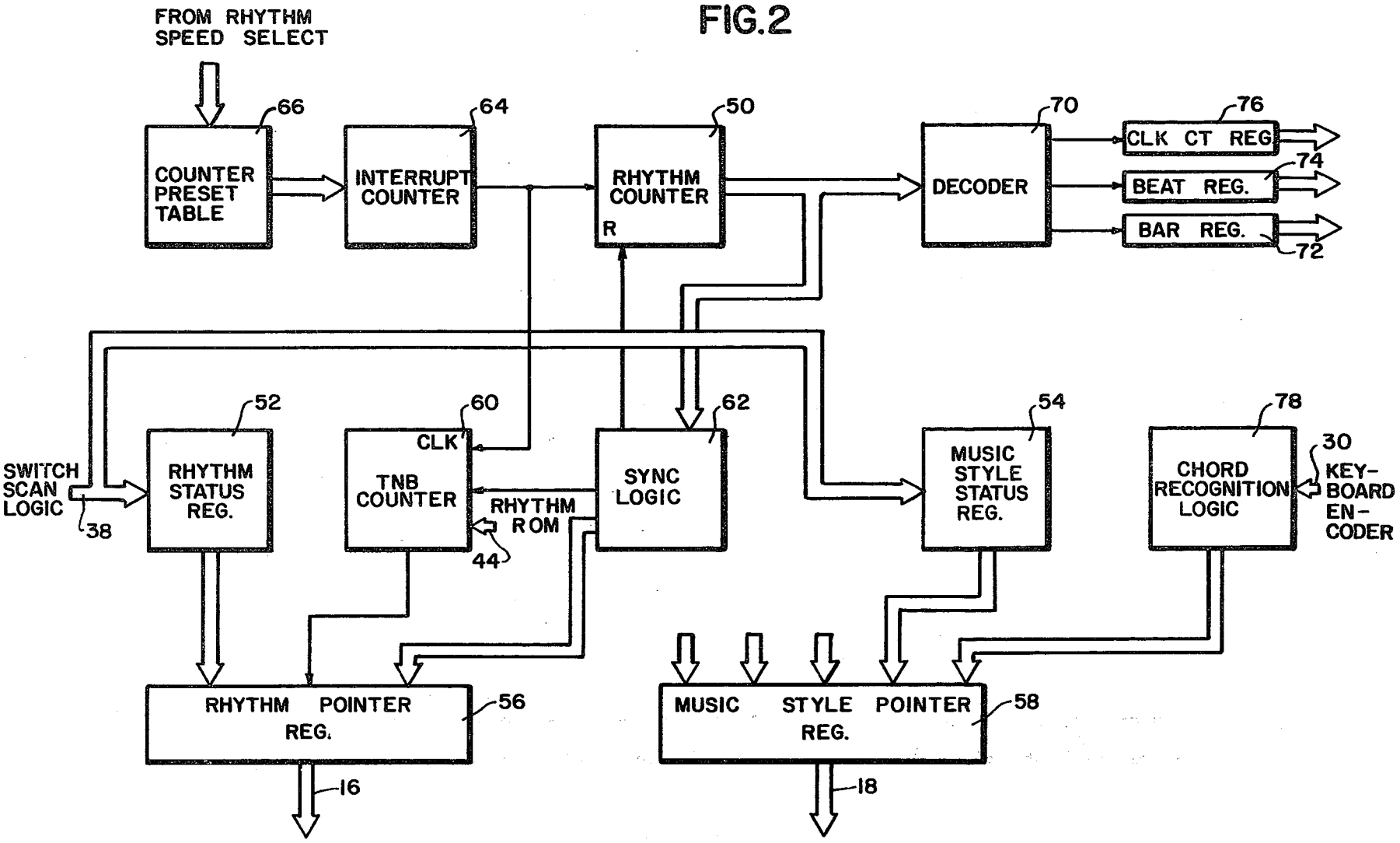
FIG. 2 is a more detailed block diagram illustrating the microprocessor shown generally in FIG. 1.
Figure 3:
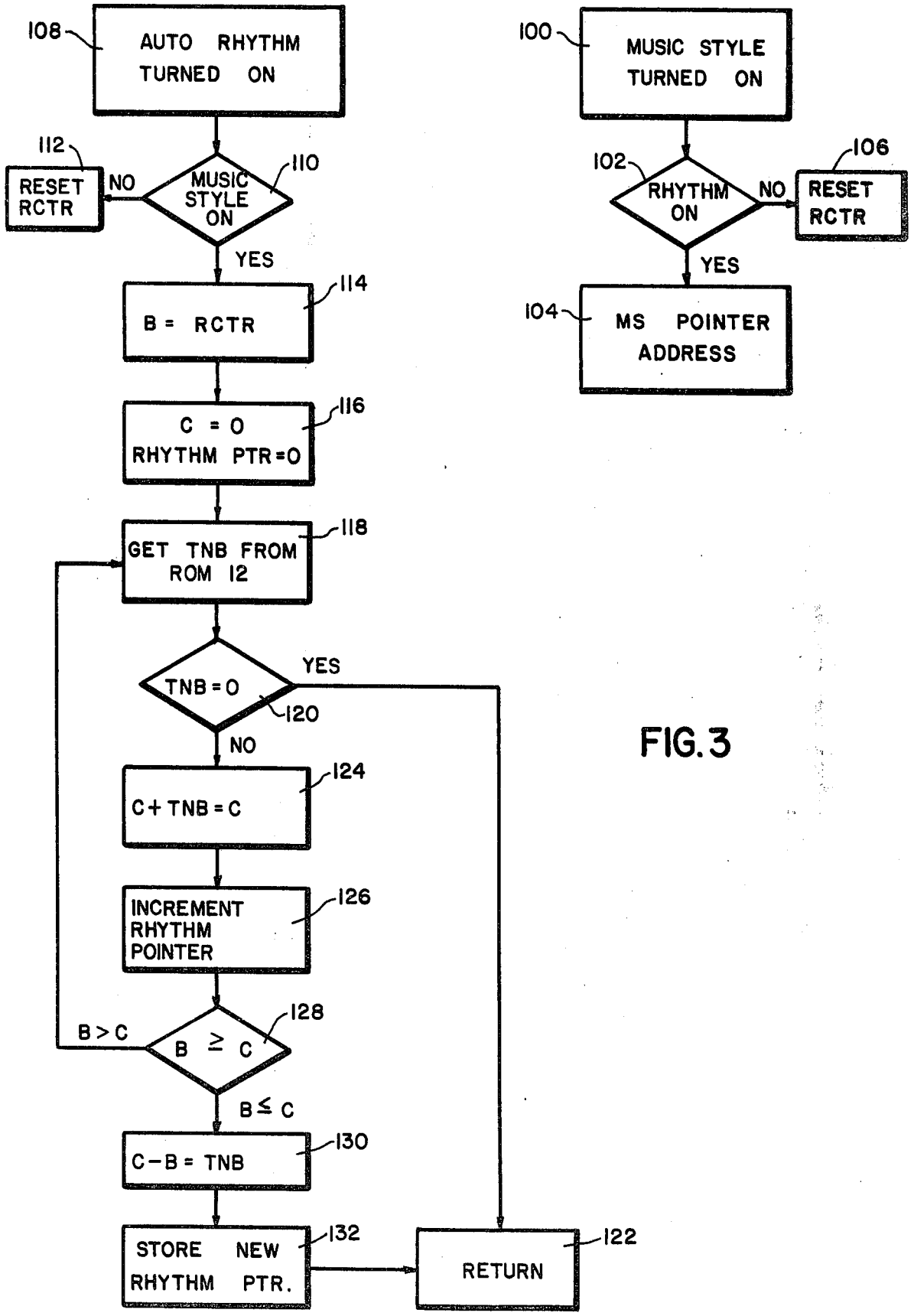
FIG. 3 is a flow chart illustrating the operation of the synchronization technique of the present invention.

FIG. 2 illustrates the organization of microprocessor 10 and the flow chart of FIG. 3 illustrates the manner in which the synchronization technique of the present invention is implemented thereby. Referring first to FIG. 2, it will be seen that the output of switch scan logic 36 is coupled to the input of a rhythm status register 52 and to the input of a music style status register 54. It will be recalled that the output of switch scan logic 36 defines the player selected rhythm and/or music style patterns. The selected rhythm pattern is stored in register 52 whose output forms one input to a rhythm pointer register 56. Rhythm pointer register 56 develops the address signals on address bus 16 for addressing rhythm ROM 12. In particular, the bits of rhythm pointer register 56 derived from rhythm status register 52 are used to enable the consecutive memory locations of ROM 12 storing the selected two-bar rhythm pattern. In a similar manner, the selected music style pattern is stored in register 54 whose output forms one input to a music style pointer register 58. Music style pointer register 58 develops the address signals on address bus 18 for addressing music style ROM 14 and, in particular, the bits of music style pointer register 58 derived from music style status register 54 are used to enable the memory locations of ROM 14 storing the selected two-bar music style pattern.

The rhythm pointer register 56 also receives inputs from a TNB counter 60 and synchronization logic 62. TNB counter 60 is preset according to the TNB code associated with each addressed rhythm beat instruction of ROM 12 and is clocked in response to a sequence of equally spaced interrupt pulses (defining a plurality of equally spaced time points) derived from the output of an interrupt counter 64. The spacing of the interrupt pulses is determined by a preset value derived from a counter preset table 66 which is operated in response to the speed select code developed according to the player-selected setting of rhythm speed select circuit 40. TNB counter 60 is operable for counting the interrupt pulses until a value equal to the current TNB code developed on bus 44 is achieved and then outputing an instruction incrementing the state of rhythm pointer register 56 for addressing the next consecutive rhythm beat instruction. In this manner, each rhythm beat instruction is performed in turn for a number of equally spaced time points according to the associated TNB code, the entire two-bar pattern being completed in ninety-six time points. The input to rhythm pointer register 56 from synchronization logic 62 is used to appropriately set the state of register 56 when the automatic rhythm feature is initiated while the music style feature is running as will be described in further detail below. Synchronization logic 62 also supplies a preset input of TNB counter 60 to further facilitate synchronous operation of the two automatic features.

The interrupt pulses developed by interrupt counter 64 are also supplied to the clock input of rhythm counter 50 which completes one counting cycle for every ninety-six interrupt pulses, which counting cycle defines the time interval corresponding to a two-bar musical pattern. The state of rhythm counter 50 is supplied to an input of synchronization logic 62 and also to an input of a decoder 70. Decoder 70 decodes the states of rhythm counter 50 and supplies decoded signals to a bar register 72, a beat register 74 and a clock count register 76. The decoded signals stored in bar register 72 define whether the first bar (rhythm counter states 0–47) or the second bar (rhythm counter states 48–95) of the musical pattern is being played. The decoded signals stored in beat register 74 define which of the eight beats of the musical pattern are being played, the first beat corresponding to states 0–11 of rhythm counter 50, the second beat corresponding to states 12–23, and so on. Clock count register 76 stores the decoded states of rhythm counter 50 representing the 12 count cycles that will occur during each beat (12 (counts)×8 (beats)=96 timepoints/zbar pattern).

The outputs of bar register 72, beat register 74 and clock count register 76 are coupled to the input of music style pointer register 58 for partially defining the address supplied by address bus 18 to the music style ROM 14. In addition, music style pointer register 58 receives inputs from music style status register 54 which defines the music style pattern selected by the player for performance and from a chord recognition logic 78 which decodes the chord and chord type being played on keyboard 26. The address signals supplied to music style ROM 14 are thus completely specified by the states of registers 72–76 (defining the bar, beat and clock count interval of the musical pattern being played), the state of music style register 54 (defining the player-selected music style pattern) and the output of chord recognition logic 78 (defining the chord and chord type being played on keyboard 26).

The flow chart of FIG. 3 illustrates the operation of synchronization logic 62 for achieving synchronous operation of the automatic rhythm and music style features according to the invention. Synchronization logic 62 is preferably implemented in the form of a program ROM, a detailed program instruction listing for which is attached hereto as Appendix A, controlling the CPU of microprocessor 10 and is shown as a single block in the drawing for purposes of convenience only.

Referring to FIG. 3, assume initially that the player activates the automatic music style feature, represented by instruction 100, by operating one of the music style switches 34. In accordance with decision block 102, if the automatic rhythm feature is also in operation the initial address supplied to music style ROM 14 is the current state of music style pointer register 58 in accordance with instruction 104. Since interrupt pulses are continuously being developed by interrupt counter 64 and commonly clock both TNB counter 60 as well as rhythm counter 50 (which was reset upon initiation of the automatic rhythm feature), the decoded states of rhythm counter 50 stored in registers 72–76 define the number of interrupt pulses received by TNB counter 60 from the beginning of a ninety-six time point cycle. Therefore, use of the current state of music style pointer register 58 to address music style ROM 14 will result in both the two-bar automatic rhythm pattern stored in ROM 12 and the two-bar music style pattern stored in ROM 14 being completed in time coincidence and the subsequent synchronous operation thereof.

With further reference to decision block 102, if the automatic rhythm feature is not operating when the music style feature is turned on, rhythm counter 50 will be reset in accordance with instruction 106. Resetting of rhythm counter 50 results in registers 72–76 being initialized so that the first memory location of the selected music style pattern stored in ROM 14 is addressed and the music style pattern begins playing from its starting point.

Assume now that the automatic rhythm feature is turned on, as represented by instruction 108, by operating one of the rhythm switches 32. As indicated by decision block 110, if the music style feature is not operated an instruction 112 is executed resetting rhythm counter 50. As a result, registers 72–76 are initialized as previously explained (to insure system synchronization if the music style feature is subsequently turned on) and the selected rhythm pattern begins playing from its starting point.

If, on the other hand, the music style feature is operating when the automatic rhythm feature is turned on a subroutine beginning with instruction 114 is executed. This subroutine is used to calculate the states to which TNB counter 60 and rhythm pointer register 56 should be preset to insure that the two-bar rhythm and music style patterns terminate coincidentally to achieve synchronous operation. In particular, in accordance with instruction 114 a register B is set to the current state of rhythm counter 50 and rhythm pointer register 56 and a register C are initialized to 0 in accordance with an instruction 116. Next, the TNB code associated with the first memory location of the selected rhythm pattern (remember that rhythm pointer register 56 had previously been initialized for addressing the first memory location of ROM 12) is fetched per instruction 118 and tested to determine whether it has a zero value by decision block 120. The two-bar rhythm patterns are programmed in ROM 12 such that only the TNB code associated with the final beat instruction has a zero value. Therefore, fetching of the final TNB code (represented by a zero value) results in an exit from the subroutine to a return instruction 122 and otherwise the subroutine is continued with an instruction 124.

Execution of instruction 124 results in the currently fetched TNB code being added to the value stored in register C. Next, rhythm pointer register 56 is incremented for addressing the next memory location of rhythm ROM 12 in accordance with instruction 126 and the contents of registers B (the state of rhythm counter 50) and C (the cumulative total of the fetched TNB codes) are compared according to decision 128. If the current value of the B register is greater than the current value of the C register, the subroutine returns to instruction 118 where the TNB code associated with the second rhythm beat instruction is fetched. The foregoing process is repeated until it is determined by block 128 that the value in the B register is less than or equal to the value of the C register. At this point, rhythm pointer register 56 will be addressing the memory location of rhythm ROM 12 storing a TNB code which, when added to the values of all proceding TNB codes of the selected rhythm pattern yields a total equal to or greater than the state of rhythm counter 50. If the accumulated TNB code value (register C) is greater than the state of rhythm counter 50 (register B), the excess is determined and used to preset the TNB counter 60 in accordance with instruction 130. Accordingly, the states of rhythm pointer register 56 and TNB counter 60 are preset by the subroutine such that the rhythm pattern will be completed in time coincidence with the on-going music style pattern insuring system synchronization. That is, a number of interrupt pulses equal to ninety-six minus the current state of the rhythm counter 50 will be processed by TNB counter 60 whereupon the selected rhythm pattern will be re-initiated at its starting point in time synchronism with the on-going music style pattern.

Figure 4:
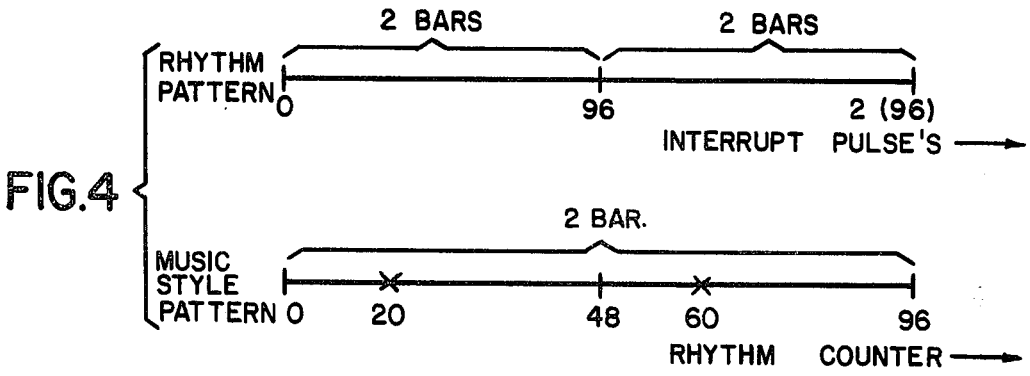
FIG. 4 is a graphical diagram showing the relation of a "four-bar" rhythm pattern to an accompanying music style pattern.
Figure 5:
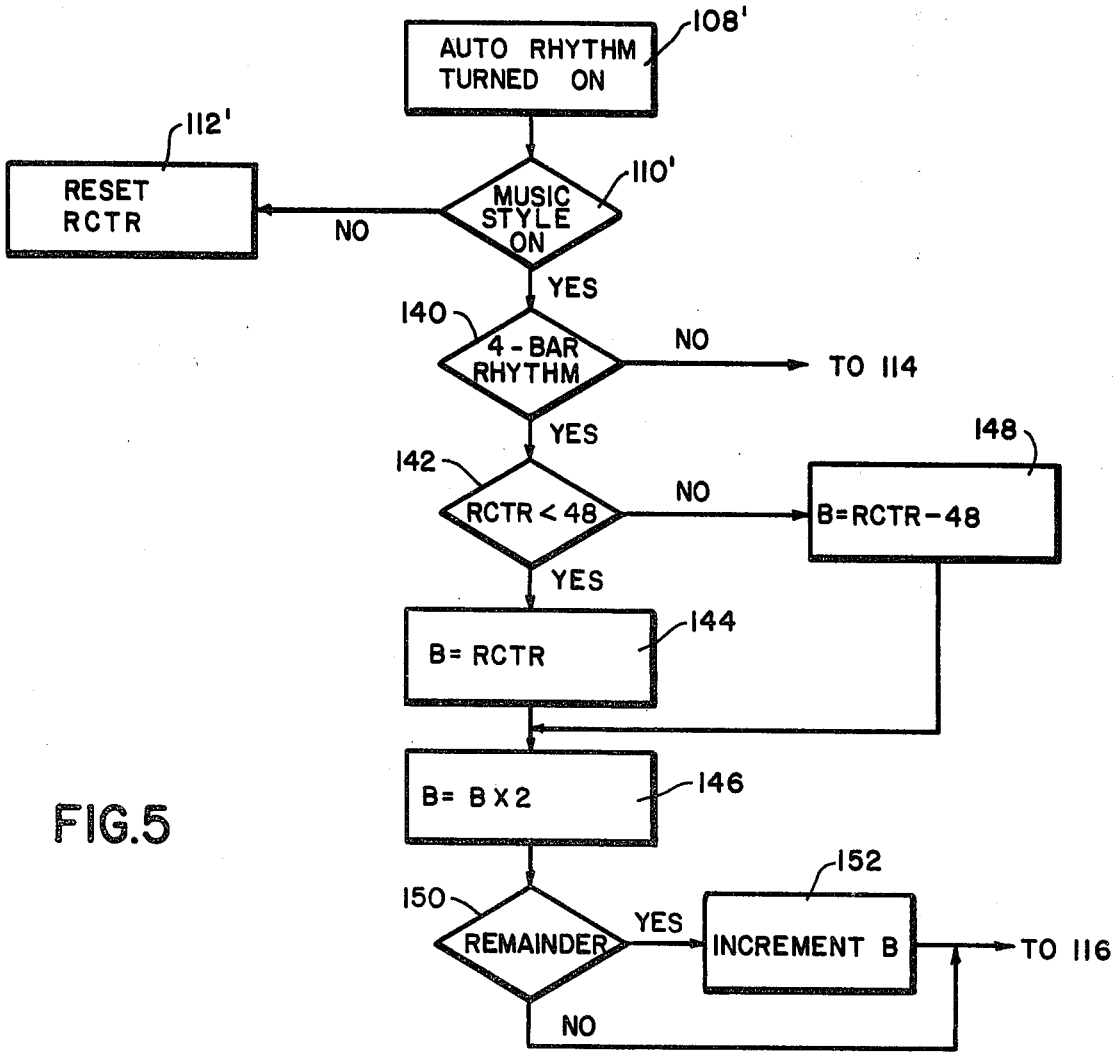
FIG. 5 is a flow chart illustrating an extension of the synchronization technique of the invention to a "four-bar" rhythm pattern as illustrated in FIG. 4.

FIGS. 4 and 5 illustrate an extension of the invention whereby so-called "four-bar" rhythm patterns may be accommodated by the synchronization technique described above. A "four-bar " rhythm pattern is one which is played at twice the effective speed of a simultaneously played music style pattern and is implemented in the circuitry of FIG. 2 by operating rhythm counter 50 for counting every other interrupt pulse developed by interrupt counter 64. Therefore, since the speed of the rhythm pattern is determined by the rate of the interrupt pulses, the rhythm pattern will be sounded at a rate effectively twice that of the music style pattern.

The foregoing is illustrated by the graphs of FIG. 4. The first graph shows a pair of two bar rhythm patterns each corresponding to ninety-six interrupt pulses or time points. The second graph shows two bars of a music style pattern, which two bars occupy the same time interval as the pair of two bar rhythm patterns since the rhythm counter is clocked in response to only every other interrupt pulse. Now, assume that a "four-bar" rhythm pattern is turned on while a music style pattern is being played with the state of rhythm counter 50 being equal to 20 as shown in the drawing. In this case, synchronization will be achieved by entering the first two bar rhythm pattern at a point selected for causing the two bar rhythm pattern to terminate coincidentally with the termination of the first bar of the on-going music style pattern. Since rhythm counter 50 must be clocked 28 additional times to reach the end of the first bar of the music style pattern, the rhythm pointer register 56 and TNB counter 60 must be preset such that 56 interrupt pulses are required to reach the end of the two bar rhythm pattern. This can be accomplished by setting the previously mentioned B register to 40 ($96-56=40$) and executing the subroutine of FIG. 3 starting from instruction 116.

If a "four-bar" rhythm pattern is turned on while a music style pattern is being played with the state of rhythm counter being equal to a value greater than 48, e.g. 60, synchronization can be achieved by entering the second two-bar rhythm pattern at a point selected for causing the second two-bar rhythm pattern to terminate coincidentally with the termination of the second bar of the on-going music style pattern. This is accomplished by executing the subroutine of FIG. 3 with register B preset to twice the difference of the state of rhythm counter 50 and the value 48 (i.e. $2\times(60-48)=24$). Synchronization is achieved since rhythm counter 50 is clocked 36 more times to reach the end of the second bar of the music style pattern ($60+36=96$) while TNB counter 60 is clocked 72 more times ($96-24$) to time coincidentally reach the end of the second two bar rhythm pattern.

FIG. 5 illustrates a subroutine which may be used in association with the subroutine of FIG. 3 to implement the "four-bar" rhythm pattern synchronization technique described above. After the automatic rhythm feature is turned on (block 108') a test 110' is made to determine whether the music style feature is also playing. If the music style feature is not on, rhythm counter 50 is reset (block 112') as in the subroutine of FIG. 3. If the music style feature is on then a further test 140 is performed to determine whether a "four-bar" rhythm pattern has been selected. If a "four-bar" rhythm pattern has not been selected the subroutine of FIG. 3 is executed as previously described beginning with instruction 114. On the other hand, if a "four-bar" rhythm pattern has been selected, the state of rhythm counter 50 is tested (block 142) to determine whether it is greater or less than 48. If less than 48, e.g. 20 in the previous example, register B is set to the state of the rhythm counter (block 144) and then doubled in value (block 146) to yield the previously described value of 40. If the state of the rhythm counter is greater than 48, e.g. 60 in the above example, register B is set to a value equal to the state of rhythm counter 50 minus 48 (i.e. 60−48=12) in accordance with instruction 148, this value then being doubled in accordance with instruction 146 to yield the previously described value of 24. If, as in the example used herein, the state of the rhythm counter is even (block 150) when the "four-bar" rhythm pattern is turned on, the subroutine of FIG. 3 is executed using the value for register B calculated above. If, however, the state of the rhythm counter is odd, register B is incremented by instruction 152 and then the subroutine of FIG. 3 is executed.

The particular embodiment disclosed, while preferred, is only one example of how the principles of this invention can be reduced to practice. Various other specific applications, all within the scope of the appended claims, may be imagined.

I claim:

1. An electronic musical instrument comprising:

means continuously developing a clock signal defining a sequence of clock intervals;

a first memory addressable for repetatively implementing a first musical pattern of N-bars of a first automatic play feature in accordance with a plurality of first instructions stored at a plurality of consecutive memory locations thereof, each of said first instructions including an associated timing code representing a number of said clock intervals until the next memory location of said first memory is to be addressed;

a second memory addressable for implementing a second musical pattern of N-bars of a second automatic-play feature in accordance with a plurality of second instructions stored at a plurality of memory locations thereof; and means operable in response to said clock signal and said timing codes for addressing said first memory and in response to said clock signal for addressing said second memory such that said first and second N-bar musical patterns are completed in time coincidence regardless of the times of initiation of operation of said first and second automatic play features.

2. An electronic musical instrument according to claim 1 wherein said means for addressing comprises a second address register for addressing said second memory, means continuously decoding said clock signal for developing a control code tracking the extent of completion of said N-bars of said first musical pattern and means coupling said control code to said second address register, whereby upon initiation of said second automatic-play feature during a performance of said first automatic-play feature said second address register is set to said control code for insuring completion of said N-bar first and second musical patterns in time coincidence.

3. An electronic musical instrument according to claim 2 wherein said decoding means comprises first counting means cyclically counting a number of said clock intervals corresponding to said N-bar first musical pattern, a decoder for decoding selected states of said first counting means for forming said control code and means storing said control code.

4. An electronic musical instrument according to claim 1 wherein said means for addressing comprises a first address register for addressing said first memory and logic means responsive to initiation of said first automatic-play feature during a performance of said second automatic play feature for insuring completion of said N-bar first and second musical patterns in time coincidence.

5. An electronic musical instrument according to claim 4 including second counting means for incrementing said first address register in response to counting a number of said clock intervals corresponding to the currently addressed timing code and wherein said logic means comprises means for calculating second and third control codes for presetting said first address register and said second counting means respectively for insuring completion of said N-bar first and second musical patterns in time coincidence.

6. An electronic musical instrument comprising:

means continuously developing a clock signal defining a sequence of clock intervals;

a first memory addressable for repetitively implementing a first musical pattern of N-bars of a first automatic play feature in accordance with a plurality of first instructions stored at a plurality of consecutive memory locations thereof, each of said first instructions including an associated timing code representing a number of said clock intervals until the next memory location of said first memory is to be addressed;

a second memory addressable for implementing a second musical pattern of N-bars of a second automatic-play feature in accordance with a plurality of second instructions stored at a plurality of memory locations thereof;

first counting means cyclically counting a number of said clock intervals corresponding to said N-bar first musical pattern;

decoding means for decoding selected states of said first counting means for forming a first control code tracking the extent of completion of said N-bars of said first musical pattern;

first address register means responsive to said clock signal and said timing codes for addressing said first memory;

second address register means responsive to said first control code for addressing said second memory; and logic means responsive to said clock signal for developing and coupling a second control code to said first address register means in response to initiation of said first automatic-play feature during a performance of said second automatic-play feature for operating said first address register means for insuring completion of said N-bar first and second musical patterns in time coincidence.

7. An electronic musical instrument according to claim 6 wherein said decoding means comprises a decoder for decoding said selected states of said first counting means for forming said first control code, means coupled to said decoder for storing said first control code and means coupling said stored first control code to said second address register means.

8. An electronic musical instrument according to claim 6 wherein said first address register means comprises a first address register and second counting means for incrementing said first address register in response to counting a number of said clock intervals corresponding to the currently addressed timing code and wherein said logic means comprises means for calculating third and fourth control codes representing said second control code for presetting said first address register and said second counting means respectively for insuring completion of said N-bar first and second musical patterns in time coincidence.

9. An electronic musical instrument according to claim 8 wherein said third and fourth control codes represent the smallest cumulative total of the M first consecutive stored timing codes whose value is equal to or greater than the current state of said first counting means.

10. An electronic musical instrument according to claim 9 wherein said third control code represents the Mth memory location of said first address register and wherein said fourth control code represents the difference between said cumulative total of timing codes and the current state of said first counting means.

11. An electronic musical instrument according to claim 6 wherein said first counting means is operable for counting every other one of said clock intervals and wherein N equals two such that two bars of said second musical pattern corresponds in time to first and second consecutively occurring two-bar first musical patterns, said logic means being responsive to said first counting means and operable upon initiation of said first automatic-play feature during the performance of a first bar of said two-bar second musical pattern for operating said first address register means for insuring completion of said first consecutively occurring two-bar first musical pattern in time coincidence therewith and operable upon initiation of said first automatic-play feature during the performance of a second bar of said two-bar second musical pattern for operating said first address register means for insuring completion of said second consecutively occurring two-bar first musical pattern in time coincidence therewith.

* * * * *